US005294912A

United States Patent [19]

Bednarz et al.

[11] Patent Number: 5,294,912

[45] Date of Patent: Mar. 15, 1994

[54] LONG JUMP AND TRIPLE JUMP FOUL DETECTOR SYSTEM

[75] Inventors: John Bednarz; John Hoaglund, both of Elmhurst; Roger L. Rosenberg, Arlington Heights; Lula P. Taylor, Bolingbrook, all of Ill.; Michael C. Taylor, late of Bolingbrook, Ill., by Lula P. Taylor, legal representative

[73] Assignee: Lumi Sport Products, Inc., Bensenville, Ill.

[21] Appl. No.: 733,841

[22] Filed: Jul. 22, 1991

[51] Int. Cl.[5] ..... G08B 23/00

[52] U.S. Cl. ..... 340/323 R; 340/555; 340/556; 340/557; 364/410; 250/491.1; 250/336.1; 273/86 R

[58] Field of Search ..... 340/323 R, 555–557; 364/410, 411; 273/86 R, 86 C, 86 D; 250/491.1, 336.1, 200, 216; 356/400, 399

[56] References Cited

U.S. PATENT DOCUMENTS

| | | | |
|---|---|---|---|
| 2,299,798 | 10/1942 | Colson et al. | 340/323 R |
| 2,455,909 | 12/1948 | Smith | 340/323 B |
| 2,547,332 | 4/1951 | Loveless et al. | 340/323 R |
| 3,743,290 | 7/1973 | Crimmins et al. | 340/323 B |
| 3,752,588 | 8/1973 | Chapman | 340/323 R |
| 4,004,805 | 1/1977 | Chen et al. | 340/323 R |
| 4,186,388 | 1/1980 | Robinson | 340/323 R |

*Primary Examiner*—Donnie L. Crosland
*Attorney, Agent, or Firm*—Hill, Steadman & Simpson

[57] ABSTRACT

A long or triple jump foul detector system is disclosed which very accurately detects a foul by an athlete when a portion of an athlete's shoe crosses over a foul line when beginning the jump. A laser beam is emitted parallel to and directly above the foul line. A laser beam detector detects interruption of the laser beam by the athlete's shoe and a foul detector provides a foul indication. An audible foul indication is delayed so as not to interfere with the athlete's jump. Also, the system may provide additional detection of an athlete's foot crossing a training line positioned in front of the foul line. Furthermore, the system distinguishes between a relatively quick interruption of the beam caused by the athlete's shoe when jumping, and a relatively slow interruption of the beam which may result such as by a judge placing his or her hand in the beam when measuring a jump. The system is equally well adaptable to either indoor or outdoor long or triple jump competition, and includes convenient set-up procedures which ensure accuracy. The system also automatically compensates for varying light conditions and is effective in bright sunlight. When a low battery voltage condition arises, the system automatically alerts the operator. A micro-processor is employed for rapid and accurate control of the various functions performed by the system.

58 Claims, 12 Drawing Sheets

"POWER UP"

"SET UP"

"WAIT"

"START"

"PAUSE"

"FOUL"

66
9
EXTERNAL POWER JACK CIRCUIT
17
113
112
EXTERNAL POWER REGULATOR
65a
110
BATTERY PACK
65
111
114
67
POWER SUPPLY SWITCH & CIRCUIT
121
70
AUTO SHUT-DOWN CIRCUIT
LOW BATTERY DETECTOR CIRCUIT
72
116
START FLASH COMPARATOR
118
TURN-OFF COMPARATOR
117
119

LONG JUMP AND TRIPLE JUMP FOUL DETECTOR SYSTEM

BACKGROUND OF THE INVENTION

The invention relates to judging of the long jump and triple jump events in track and field.

In the long jump and triple jump events in track and field, it is necessary for a judge to determine whether or not each competitor has initiated his jump prior to crossing a "foul" line (also known as a scratch line). If any portion of a competitor's foot extends beyond the foul line or makes a mark after the foul line when jumping, then the jump is not measured.

It has been very difficult for track and field judges to accurately determine whether the leading portion of an athlete's foot has crossed the foul line.. This difficulty arises from the high rate of speed with which athletes approach the foul line for their take-off. It is thus difficult to determine whether a leading portion of one of the feet of the competitor crosses the foul line before the foot leaves the ground.

Previously, a layer of a deformable substance known as plasticine or the like was laid down on a board positioned immediately beyond a jumping or take-off board. However, such a film layer must be repeatedly smoothed down whenever a competitor fouls and leaves an imprint thereon. Such a prior art system is also inaccurate, since an entire toe portion of the athlete's foot may not be in direct contact with the ground, but might be slightly raised from it when he takes off for his jump, thus not leaving a proper imprint in the film layer. Variations in style by various jumpers thus may result in inconsistent foul calling. Furthermore, variations in shoe type may also affect whether or not the shoe makes an accurate mark in the deformable layer used for foul detecting.

SUMMARY OF THE INVENTION

It is an object of the invention to drastically reduce or eliminate judginq errors in the long jump and triple jump events in track and field.

It is a further object of the invention to provide more consistent judging of the long jump and triple jump events in track and field.

It is another object of the invention to make it easier for judges to determine whether an athlete has fouled in the long jump and triple jump events in track and field.

It is a further object of the invention to provide a uniform criteria for judging all athletes in the long jump and triple jump event.

It is another object of the invention to provide a training aid for long and triple jumpers to assist in attaining a close approach to the foul line, but without fouling.

According to the invention, a very accurately controlled light beam, preferably a laser beam, is projected directly above the foul line. This light beam is detected such that when an athlete's foot, and particularly the toe portion thereof, interrupts a portion of the light beam, a foul is accurately detected on a uniform basis. Preferably, foul detection occurs when at least half of the light beam is interrupted.

Furthermore, with the invention an alignment technique for the laser beam is provided which results in a convenient and accurate set-up of the system at the track meet location.

Also according to the invention, the system is able to distinguish between an actual foul occurring as a result of a rapid intrusion of the athlete's foot into the light beam compared to a non-foul situation when a judge is holding a tape measure or the like to the foul line for measurement purposes after a jump has occurred. In such case, a foul alarm indication will not be given.

Also, according to the invention, a foul alarm occurs in a delayed fashion after the athlete fouls so as not to interfere with the athlete's jump.

The invention also provides a system wherein low battery power is automatically detected, but without initially interfering with the operation of the system, yet still providing a warning of the low battery condition.

The system of the invention is suited for rapid and easy setup, yet provides accurate foul detection, ensures the legality of the jump, and reduces the incidence of erroneous calls.

The system of the invention is also useful to the athlete during practice since in such a case the athlete can determine how close he is coming to the foul line without actually fouling, without the use of an official or another person monitoring the potential foul.

As a further aid to the athlete who is training for the long a triple jump events, the system of the invention may detect when an athlete's foot prior to a jump has come within a prescribed distance from the foul or scratch line, thus providing to the athlete an indication of his margin of error prior to actually fouling, but without actually fouling.

With the invention, the long and triple jump events can be run more efficiently at track and field competition, since judging uncertainty is reduced. Furthermore, the competitors may be more relaxed and as a result, jump better, in view of this reduction in judging uncertainty.

The system is designed to automatically compensate for different ambient light conditions so that changing conditions do not interfere with the foul detection.

In a further feature of the invention, the system automatically determines whether the laser beam transmitting unit and beam detecting unit have been set up in proper alignment with respect to each other, thus taking guess work out of whether or not the system has been properly aligned for a particular location.

The system and its related set-up is, according to the invention, compatible both with outdoor track and field events and indoor track and field events.

Additionally, the system according to the invention will detect a foul even though a front toe portion of a shoe of the athlete is not actually completely in contact with the foul line, but is spaced some distance above the foul line. Thus, various shoe styles and jumping styles of the athletes can be compensated for so that there is not a variance in foul detection from athlete to athlete.

BRIEF DESCRIPTION OF THE DRAWINGS

FIG. 17B is a second embodiment of another beam splitting arrangement used in a system similar to FIG. 16 but wherein two advanced training beams are provided; and .

DESCRIPTION OF THE PREFERRED EMBODIMENTS

Figures 1, 2A, 2B:
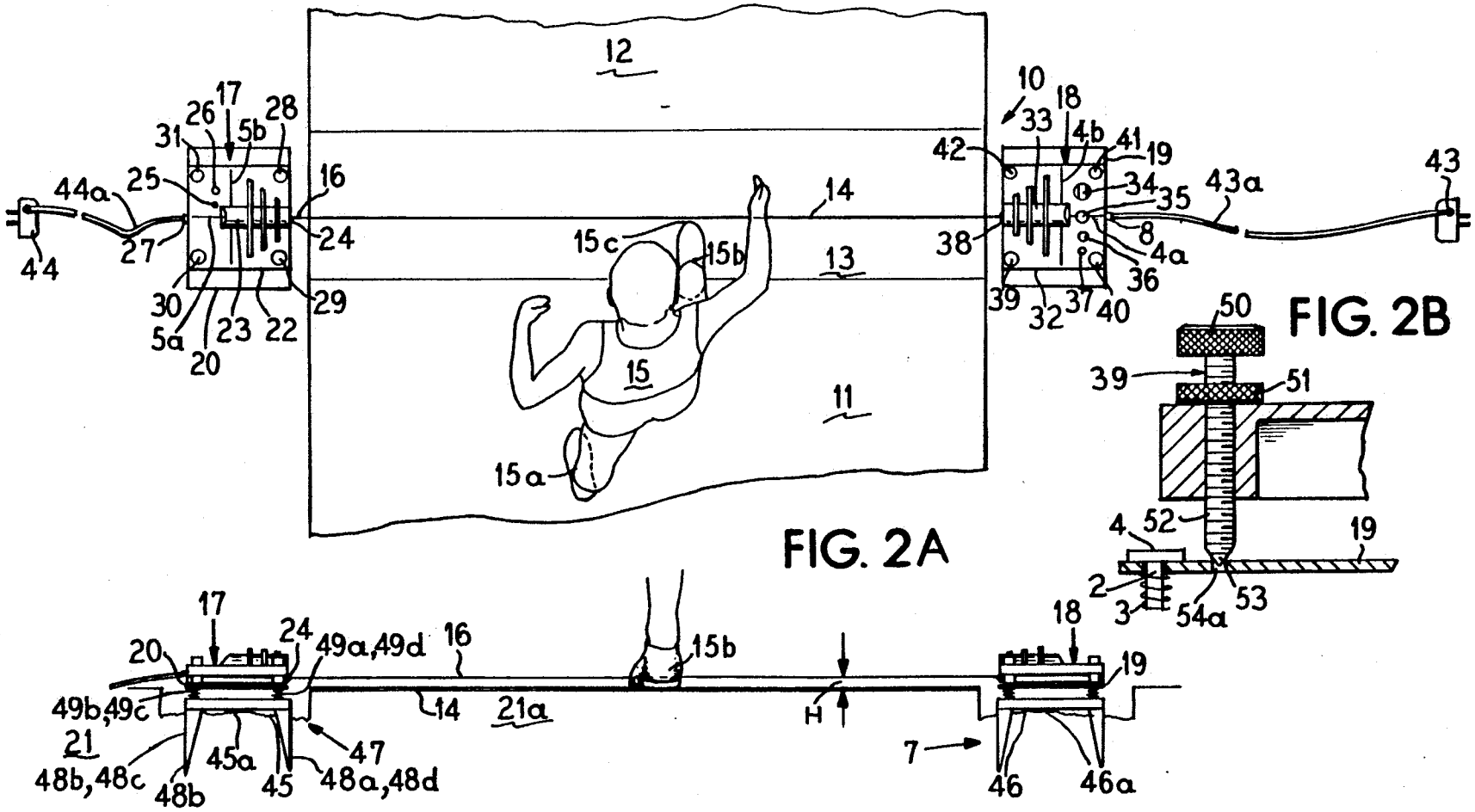
FIG. 1 is a top view of the foul detection system according to the invention as employed for detecting fouls in long jump or triple jump competition.
FIG. 2A is a ground level cross-sectional view of the system of FIG. 1 as shown installed at an outside track and field event location.
FIG. 2B is a fragmentary detailed view of an adjustment system used for a laser unit and a detector unit of the invention.

The foul detection system for the long jump and triple jump according to the invention is generally shown at 10 in the plan view of FIG. 1. For the long jump and triple jump, a runway 11 is provided for the athlete to run up to a jumping or take-off board 13 having a foul or scratch line 14 associated therewith at the trailing edge thereof. So as not to foul, the athlete 15 must ensure that neither of his feet 15*a* or 15*b*, and most particularly the leading foot 15*b*, crosses the foul or scratch line 14 prior to jumping. Thus, if he is jumping off from his right foot 15*b*, the leading edge 15*c* thereof cannot pass the vertical plane passing through the foul line 14 as he jumps toward the pit area 12 which is downstream from the runway or approach track 11.

A light beam, which is preferably a laser beam 16, is radiated from a laser unit 17, parallel and directly above the foul line 14, where it is intercepted and detected by the light detecting unit 18. The laser unit 17 is located on a locating plate 20 and the detecting unit 18 is located on a locating plate 19.

By use of a laser beam, which remains collimated, alignment is greatly facilitated and accuracy is enhanced.

The jumping board 13 is typically placed flush with a top surface of the track bed 21*a* on the ground 21, such as shown more clearly in FIG. 2A. Furthermore, as shown in FIG. 2A, the laser unit 17 is mounted on a pedestal placed in a hole 45 excavated in the ground 21. Similarly, the detecting unit 18 is placed on a platform or pedestal located in an excavated hole 46.

As shown in FIG. 1, the laser unit 17 is formed of a rigid housing 22 such as cast aluminum. The top of the housing has a rounded tubular portion 23 containing an aperture 24 through which the laser beam radiates outwardly. An LED indicator 25 indicates when the laser is activated. An on/off switch button 26 turns the unit "on" when touched and "off" when touched again. At a rear power port 27, a connection is provided for a cable 44*a* connected to an AC power supply 44 which plugs into a wall outlet when internal battery power is not used. Alternatively, an external battery pack may be used by connection to port 27.

As also shown in FIG. 1, the detecting unit 18 is formed of a housing 32 having a tubular portion 33 extending above the cast aluminum housing leading to an aperture 38 through which the laser beam passes inwardly into the housing, where it is detected. The detecting unit 18 has on its top surface an LCD display 34, a "pause" button switch 35, a "start" button 36, and an "on/off" button 37. At a rear of the unit, when internal battery power is not employed, an external power port 8 connects the cable 43*a* to an AC power source 43, which plugs into a wall outlet. Alternatively, an external battery pack may be connected to power port 8.

The display 34 indicates, among other things, a "set-up" mode, a "wait" mode, a "pause" mode, a "start" mode, a "foul" mode, and a "low battery" mode. Although not shown in the drawing of FIG. 1, a green LED may be provided which is on when the display reads "start"; a red LED may be provided which is on when the display reads "foul"; and a yellow LED may be provided which is on when the display reads "pause".

Both the laser unit 17 and the detecting unit 18 have respective adjustment feet 28, 29, 30, 31 and 39, 40, 41, 42 as shown in FIG. 1.

As shown at FIG. 2A, the laser unit 17 and detecting unit 18 are located such that the laser beam 16 will be at a height H above the foul line 14. Choice of this height H will be described later with respect to FIG. 5.

As illustrated in FIG. 2A, the laser unit 17 is located on the locating plate 20. The locating plate 20 is adjustably mounted for lateral movement relative to a platform 47 placed in the excavated hole 45. Four protruding and pointed stake-like mounting feet 48*a*, 48*b*, 48*c*, and 48*d* (48*c* and 48*d* are hidden behind 48*a* and 48*b* in FIG. 2A) are driven in stake-like fashion into the ground 21 beneath the hole 45 such that a bottom of the hole rests against the platform at 45a. In lieu of four mounting feet, only three may be provided.

The plate 20 is mounted on springs with screws passing through the middle as shown at 49a, b, c, d (49c and 49d are hidden behind 49a, 49b in FIG. 2A). A similar arrangement is provided for the detecting unit which has its locating plate 19 mounted on a platform 7 in the hole 46 such that a bottom of the platform 7 rests against a bottom of the hole 46 at 46a.

Also, according to the invention, the locating plates can be mounted for rotational movement relative to the respective platforms so that by twisting the laser unit 17 or detecting unit 18, alignment of the beam relative to the foul line and positioning of the "detecting unit" to receive the aligned beam can be effected.

Figures 3A, 3B, 4A, 4B, 5:
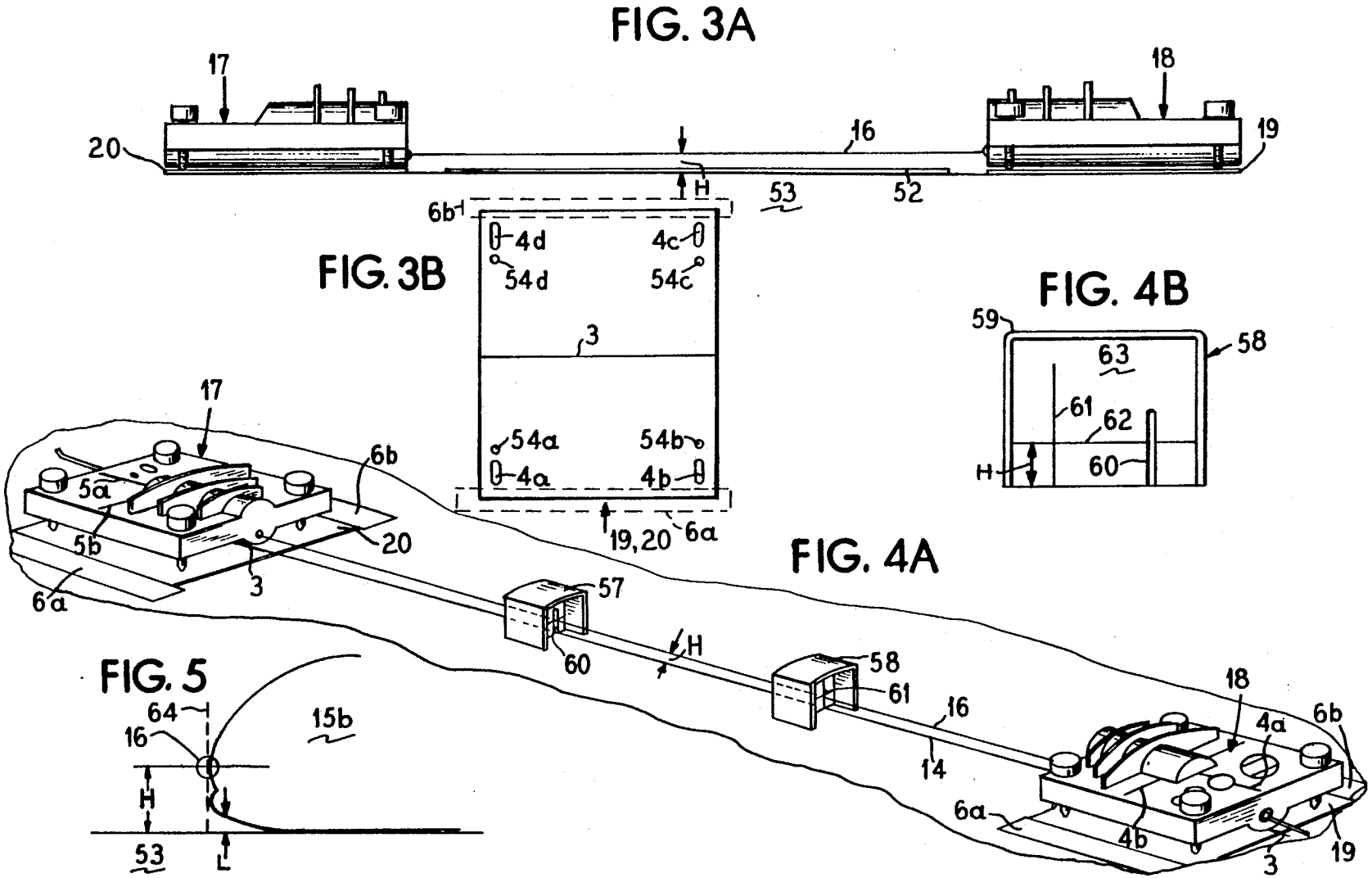
FIG. 3A is a floor level cross-sectional view of the system installed at an indoor track and field event location such as on an indoor floor.
FIG. 3B is a top view of a locating plate used in conjunction with the system of FIG. 3A.
FIG. 4A is a perspective view of the inventive foul detection system showing alignment members being used for set-up of the system.
FIG. 4B is an end view of one of the alignment members used in FIG. 4A.
FIG. 5 is a cross-sectional view of a laser beam showing an athlete's foot interrupting at least half of the laser beam in which case a foul detection occurs.

FIG. 2B shows a detail of the adjustable locating foot 39, with similar feet being provided at each of the four corners of both the laser unit 17 and detecting unit 18. It includes an adjustable screw 52 having a pointed end 53 which is received in an aperture 54a of the locating plate such as 19. A jam nut 51 locks the screw 52 in position and a levelling knob 50 is provided on an end of the levelling screw 52. The plate 19 (as is the case also with the plate 20), as shown in FIGS. 2B and 3B has a screw and spring assembly at each corner. The screw 2 of this assembly passing through spring 3 is received within slots 4a, b, c, d (See FIG. 3B) in the mounting plate 19 permitting lateral movement of the locating plate 19 or 20 in a direction upstream or downstream of the foul line 14 for positioning of the laser beam 16 directly above the foul line 14 after the respective platforms 47 and 7 have been located in their excavated holes for outdoor track events. Thus, the locating plates 19 and 20 provide lateral movement of the laser beam, whereas vertical movement of the laser beam is accomplished by the levelling screw assemblies such as 39. A centering line 3 as most clearly visible in FIGS. 3B and 4A is scribed in the locating plate 19 or 20 to aid in initial alignment as described hereafter.

FIG. 3A shows an alternative use of the inventive system at an indoor track meet location wherein the laser beam 16 is positioned above a board 52 embedded in an indoor floor 53. Again, the laser beam is positioned at a height H above the foul line at the end of the jump board 52. The laser unit 17 and detecting unit 18 are mounted on respective locating plates 19, 20 which are preferably the same as plates 19, 20 as shown in FIGS. 1 and 2, and which are laid flush on the floor 53 and fastened thereto by adhesive tape 6a, 6b or the like (shown in dashed lines in FIG. 3B) at at least two sides thereof. The locating plates 19, 20, of course, each have respective locating apertures 54a, b, c, d as previously described, for receiving the pointed ends 53 of the levelling assemblies such as 39 shown in FIG. 2B.

Set-up procedures for the inventive foul detection system are shown in FIG. 4A. First the platforms and/or the locating plates 19, 20 are positioned so that their inscribed centering lines 3 are visually aligned with the foul line 14. Thus, the laser beam 16 will be approximately centered directly above the foul line 14 associated with the jumping board 13 when the laser unit 17 and detector 18 are placed on the locating plates. The units 17 and 18 are placed on the locating plates 20, 19 with the pointed ends of the levelling screws being received in the appropriate locating aperture 54a, b, c, d of the corresponding locating plates. Furthermore, since inscribed lines 5a and 5b and 4a and 4b may be provided in the respective laser unit and detector unit 17, 18, these lines can also be used to visually check for alignment with the foul line 14.

Thereafter, for final lateral and vertical adjustment of the laser beam 16, first and second alignment units 57 and 58 as shown in FIG. 4A are employed. A detail of one of these alignment units 57 is shown in FIG. 4B. Each alignment unit is formed of an inverted U-shaped three-sided housing 59 having a vertical plate 63 located midway between ends of the housing 59. The vertical plate 63 is preferably white and has a horizontal alignment line 62 and a vertical alignment line 6I offset to one side of center. To the other side of center a slot 60 is provided intersecting the line 62.

The alignment targets are first aligned to the scratch or foul line 14. This is done by placing the slot 60 of alignment unit 57 directly over the foul line, and placing the vertical line 61 of alignment unit 58 in centered fashion over the foul line.

The alignment units 57 and 58 are each reversible such that at the position shown in FIG. 4A at 57 for the first alignment unit, the slot 60 is positioned with the beam passing through the slot. The slot has a slightly smaller width than a width of the laser beam 16. The laser beam 16 thus passes through the slot 60 where it reaches the second alignment member 58, which has a reverse orientation such that the intersection of the alignment lines 61 and 63 faces and lies in the path of the laser beam. The laser beam is thus aligned by lateral movement of the laser unit 17 and vertical movement thereof by use of the levelling screws so that the laser beam center is directed to the intersection of the slot 60 and line 62 at the first alignment unit 57, and strikes the center of the intersection point of lines 61 and 62 at the second alignment unit 58. With the above technique, the laser beam 16 has now been very accurately aligned relative to the foul line 14 at a prescribed height H defined by the guide line 62 which substantially corresponds to a height of the laser beam exiting from the laser unit 17 with the levelling screws at a mid-range point, for example.

As shown in FIG. 5, this height H is chosen so that a typical track shoe on a foot 15b will interrupt the laser beam 16 such that approximately half of a tip or toe of the shoe is below and half of a tip of the shoe is above a horizontal plane passing through the laser beam 16 at a height H above the floor 53 or ground 21. Thus, it can be seen that even though the athlete's shoe may have a deviation L above the floor 53 or ground 21, that accurate foul detection will still occur as the leading portion of the tip or toe portion of the shoe intersects the beam as shown in FIG. 5.

The system is designed such that a foul will not be detected until at least one half or more of the laser beam is interrupted, such as indicated by the vertical plane 64 in FIG. 5. As a result, the center of the beam is the foul detection reference point. Set-up and alignment are facilitated and are substantially more convenient than would be the case if only the edge of the beam was used for foul detection. This feature also enables the system to ignore small particles such as the sand and dirt a jumper might dislodge during a jump, since such particles are generally too small to interrupt one-half of the beam.

Figure 6A:
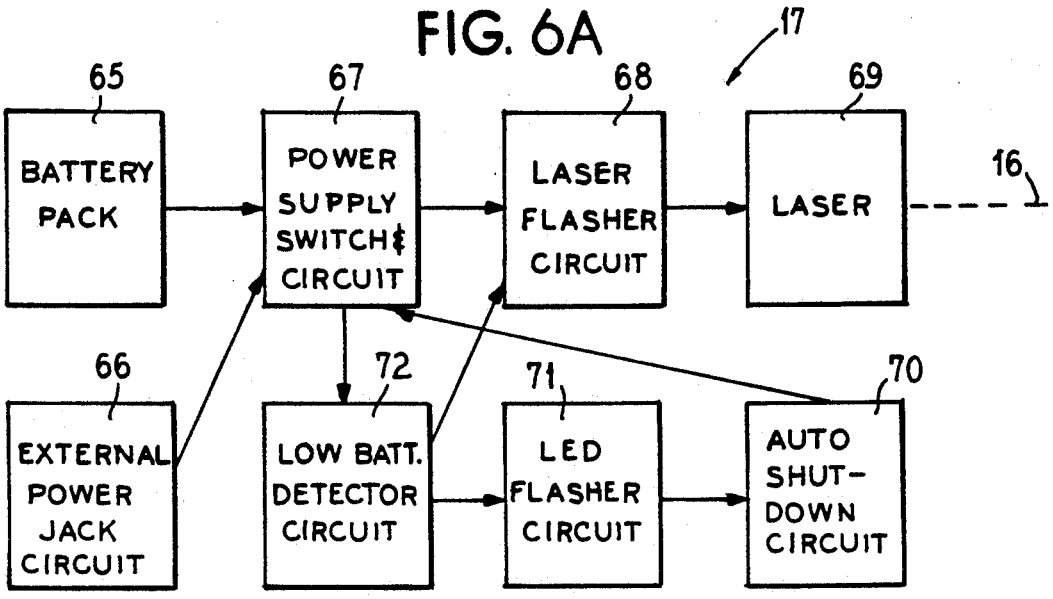
FIG. 6A is a block diagram of a laser unit of the inventive system.

FIG. 6A shows a block diagram for the laser unit 17. A battery pack 65 is provided within the housing of the laser unit 17. It connects to a power supply and switch circuit 67. An external power jack 66 also feeds the power supply 67. A laser flasher circuit 68 is energized by the power supply 67 and is controlled by the low battery detector circuit 72. The laser 69 emitting the laser beam 16 is controlled by the laser flasher circuit 68. An LED flasher circuit 71 is controlled by the low battery detector circuit 72 and in turn drives an auto shut-down circuit 70.

Figure 6B:
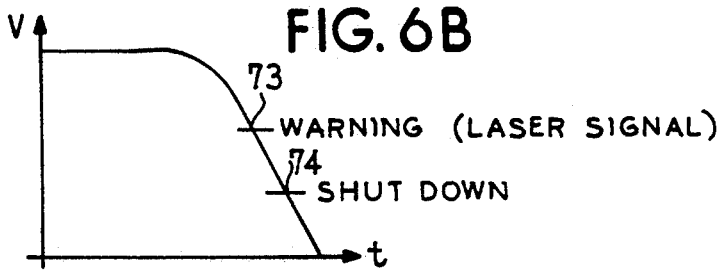
FIG. 6B is a graph used for explaining a low battery detection unit provided according to the invention.

As shown in FIG. 6B, when a low battery condition results in the laser unit 17, a warning signal occurs at 73 when the voltage V of the battery has dropped to a certain level. This causes the laser flasher circuit to increase a flashing frequency of the laser. This change in flashing frequency indicative of low battery voltage is detected by the detecting unit 18 as described hereafter. Complete shut-down occurs when the battery voltage reaches the level indicated at 74 in FIG. 6B.

Figure 7:
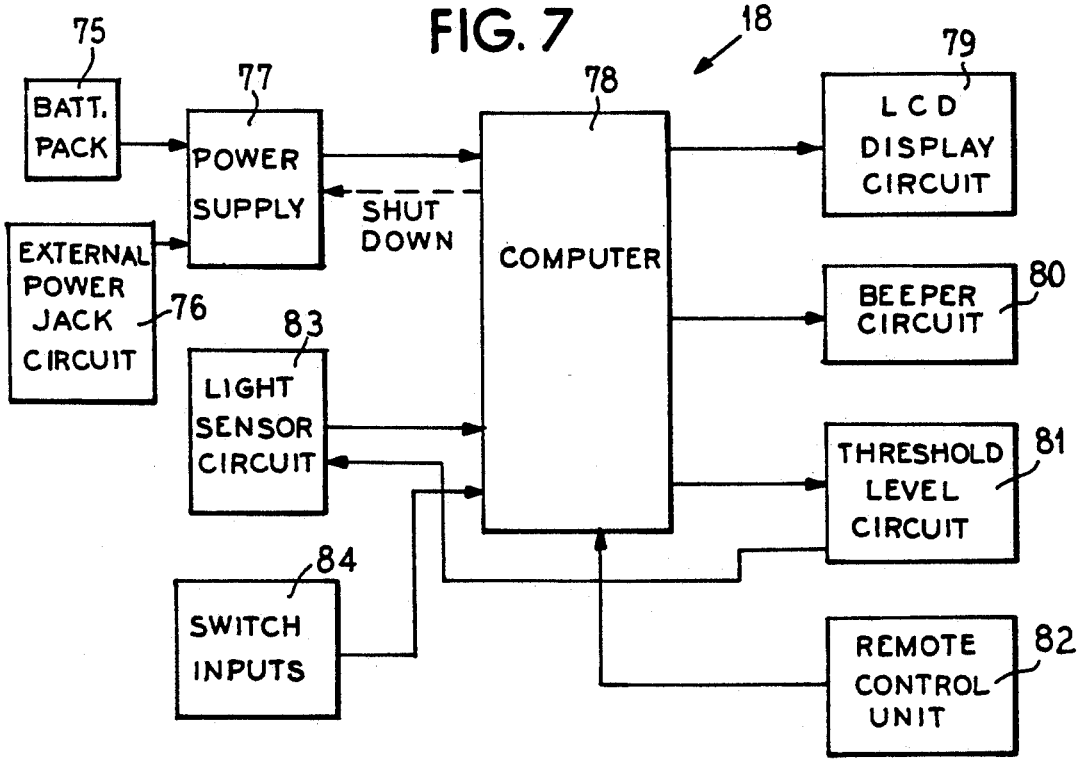
FIG. 7 is a block diagram of the laser light detecting unit according to, the invention.

The laser light detecting unit 18, as shown in FIG. 7, also has a battery pack 75 within its housing, and an auxiliary power pack 76, both connecting to the power supply 77. The power supply 77 supplies power to the computer 78. The light sensor circuit 83, which detects the laser beam 16, outputs signals to the computer 78, and also receives signals from threshold level circuit 81. Function switches are provided at the switch inputs 84 to the computer 78. The computer 78 drives an LCD display circuit 79, a beeper circuit 80, and a threshold level circuit 81. Also, if desired, a remote control unit 82 may be provided so that a track and field judge has the option to remotely control the operation of the system rather than directly touching the switches on the detector unit.

Figure 8:
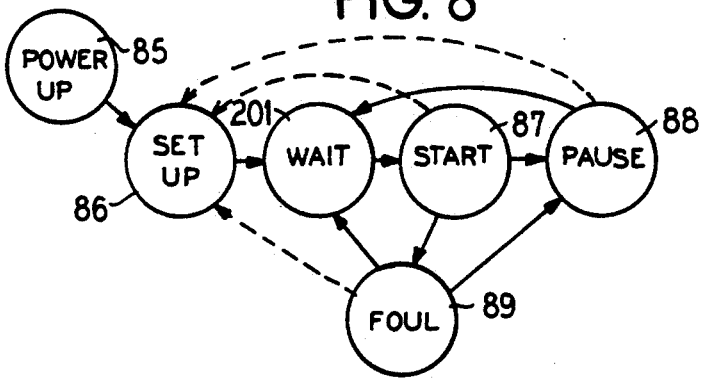
FIG. 8 is an overview flow chart for operation of the inventive system.

A memory of the computer 78, described hereafter, is programmed in accordance with the operational flow charts shown in FIGS. 8 and 9A-F. FIG. 8 is an overview flow chart showing power-up 85, set-up 86, wait 201, start 87, pause 88, and foul 89 operating modes.

Figure 9A:
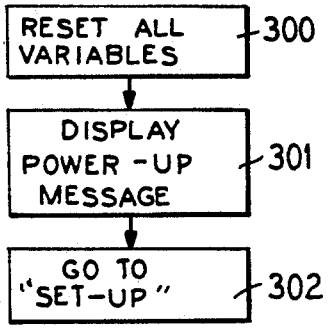
FIGS. 9A-9F are flow charts of a program stored and run by a computer employed with the system of the invention.
Figure 9B:
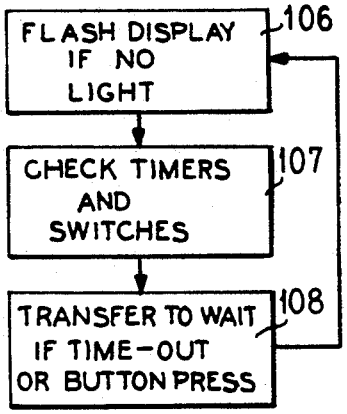
Figure 9C:
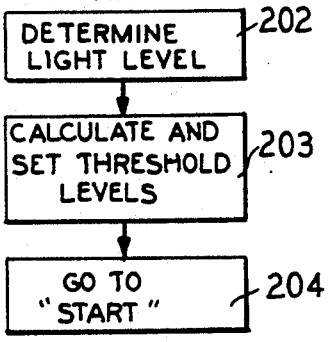
Figure 9D:
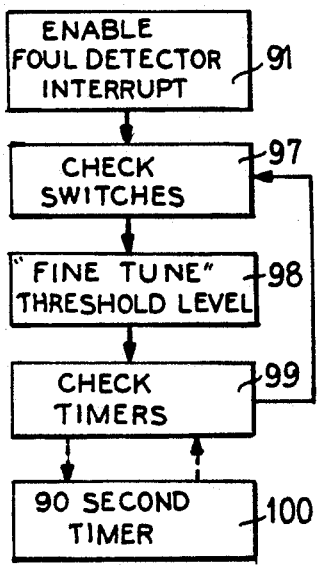
Figure 9E:
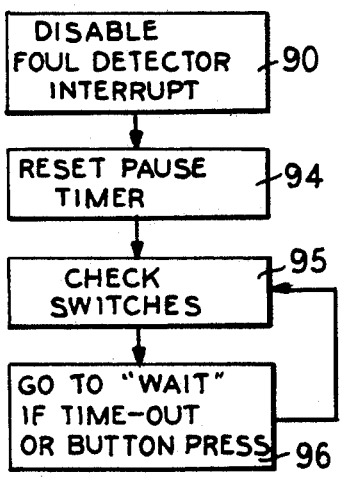
Figure 9F:
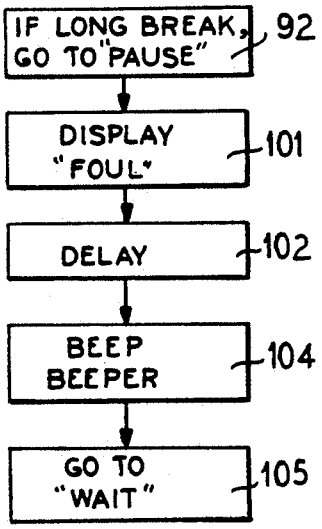

The power-up mode of FIG. 9A is entered upon the first press of the ON/OFF switch. In this mode, all variables are reset as shown at 300 and a scrolling power-up message is displayed, as shown at 301. The unit goes to set-up (302). When the set-up mode is entered (FIG. 9B), the display reads "SETUP". In this mode the display flashes (106) and the beeper beeps when the laser beam is absent from the sensor, and stops when it is present. This mode provides feedback during alignment. If the units are disturbed during operation such that alignment is lost, the unit returns to this mode to alert the operator and aid in re-alignment. If the "START" button is detected, or if a specific period of time elapses with the laser light present, the unit moves to the "WAIT" mode (107, 108).

In the wait mode (FIG. 9C), the unit samples the light hitting the sensor (202) and sets the light intensity threshold (203) at the appropriate level for the given ambient light conditions.

The start mode occurs next (204). This is the active mode (FIG. 9D) for sensing fouls. The foul-detector interrupt is enabled (91) and the unit waits in a loop watching the switch inputs and repeatedly fine tuning the threshold level (97, 98, 99). A 90 second timer (100) is provided to time the period during which the athlete should complete each jump (100).

The pause mode (FIG. 9E) is entered when the "pause" button is pressed or if a "long" break in the beam is detected. The foul interrupt is disabled (90) and the unit waits until the start button is pressed, or a time delay of approximately 12 seconds occurs (94). The unit then goes back to the wait mode (95, 96).

The foul mode (FIG. 9F) is entered when the light hitting the sensor unit is disrupted while the foul interrupt is active. The unit then checks for a long beam break idicative of an official making a measurement, and in that case transfers to the pause mode (92). If the beam break was short, indicative of a jumper breaking the beam, the unit immediately displays "FOUL", and then, after a delay (102), beeps the beeper (104). After this, the unit returns to the wait mode (105).

In any mode, if the power switch is pressed, the unit will shut itself off.

Figure 10A:
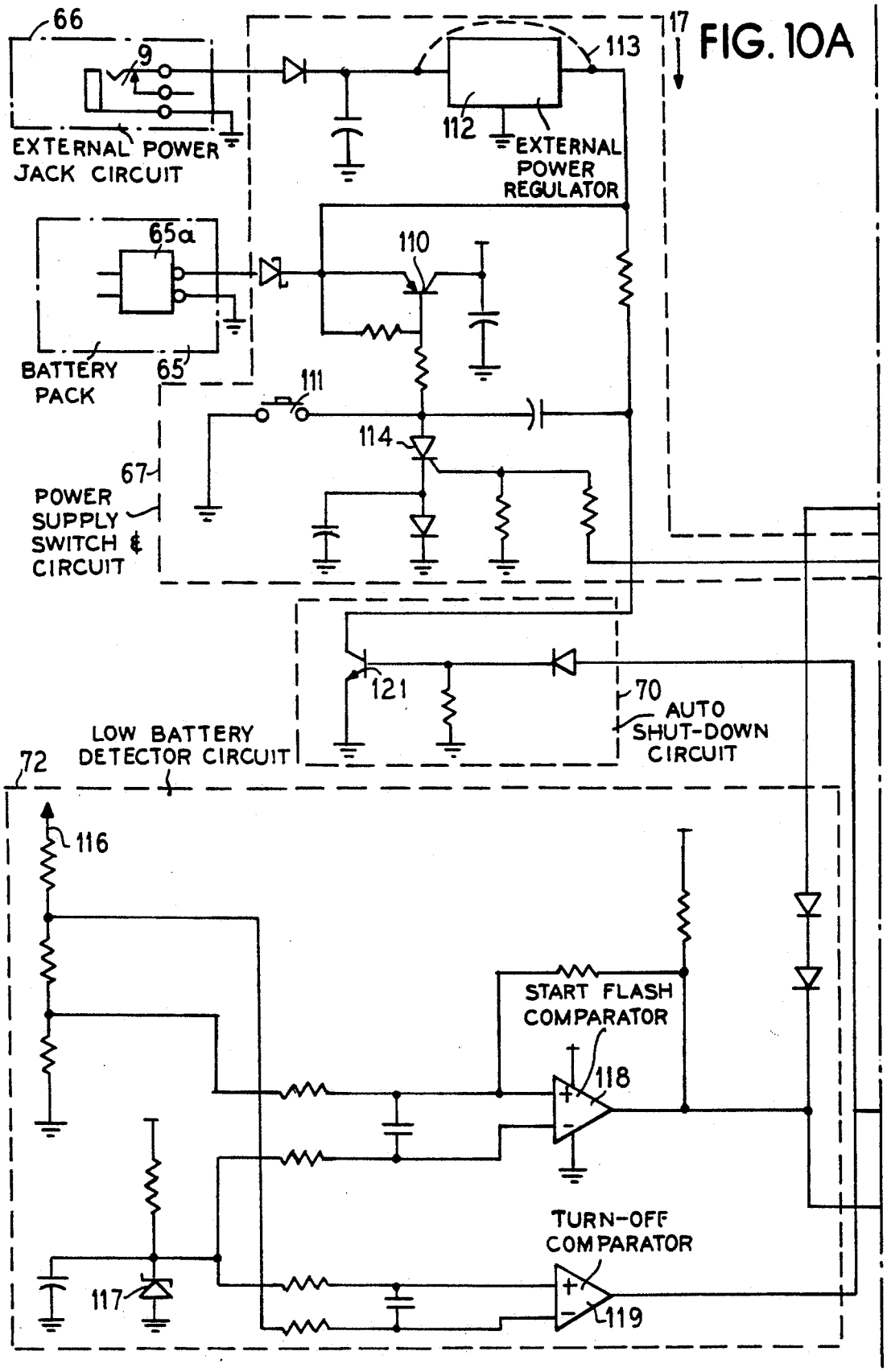
FIGS. 10A and 10B together are a schematic diagram showing make-up of the various circuit blocks for the laser unit shown in FIG. 7.
Figure 10B:
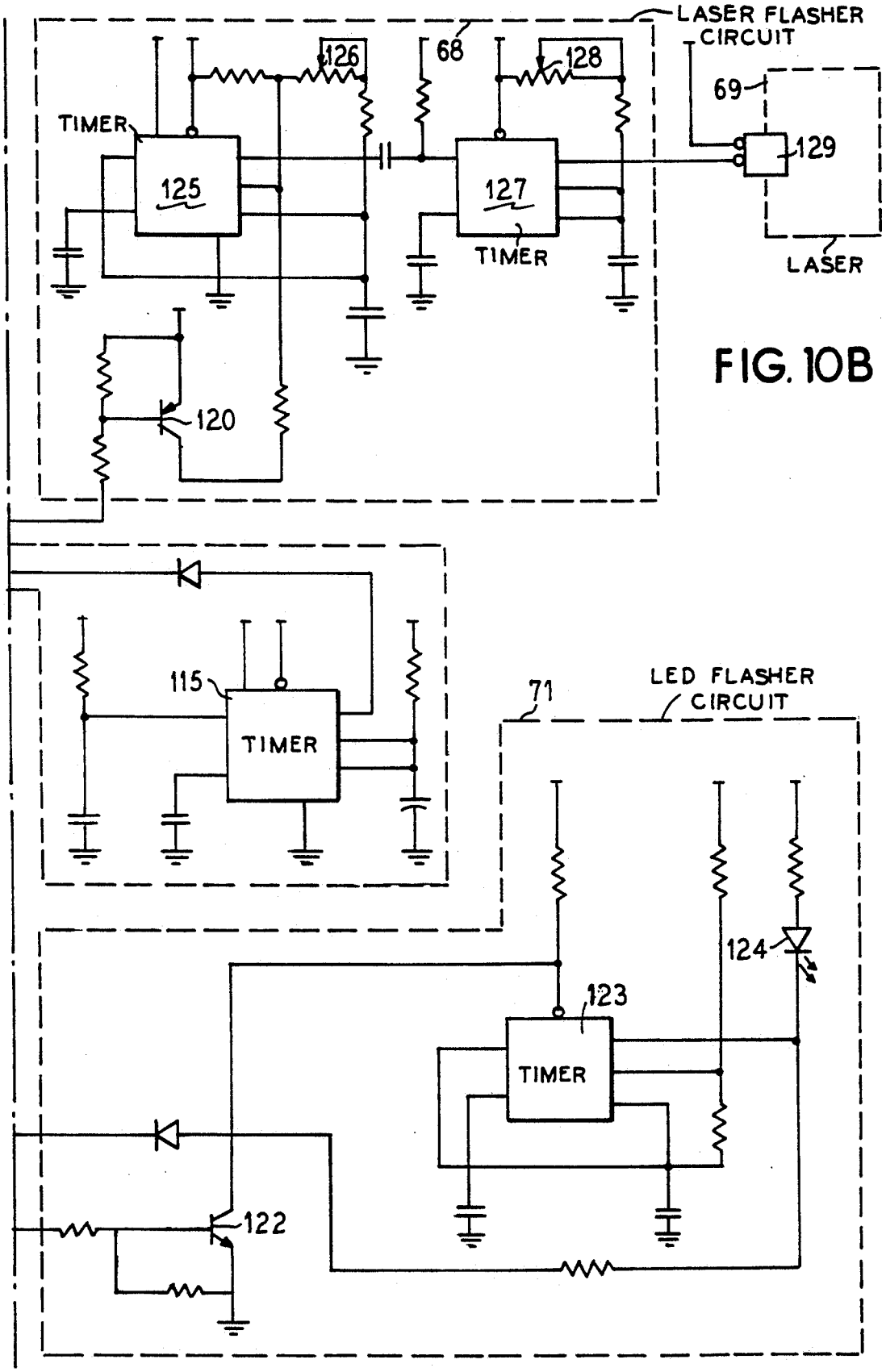
Figure 11A:
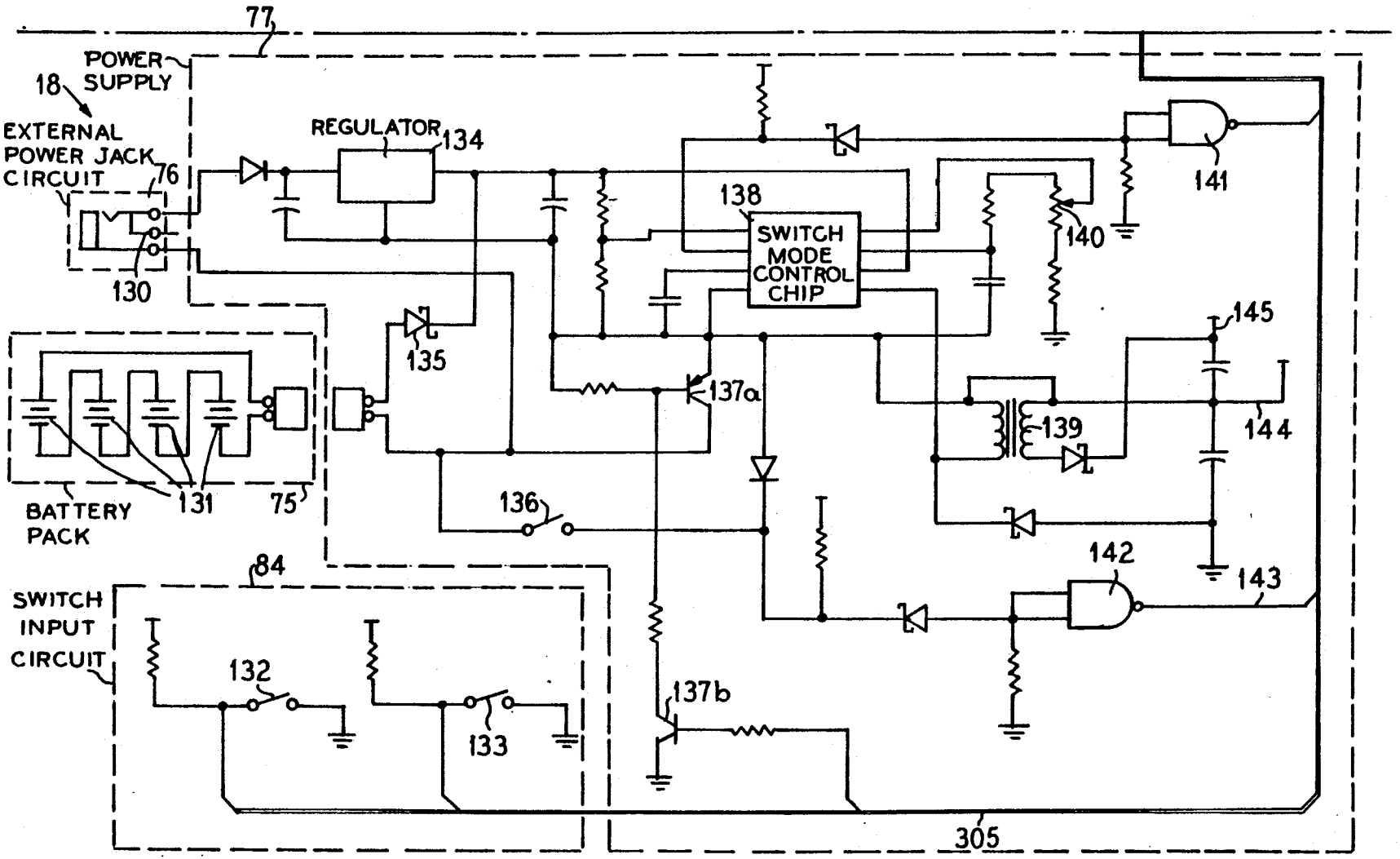
FIGS. 11A-11D taken together are a schematic diagram for the circuit blocks of the detecting unit and a related computer therein according to the block diagram of FIG. 7.
Figure 11B:
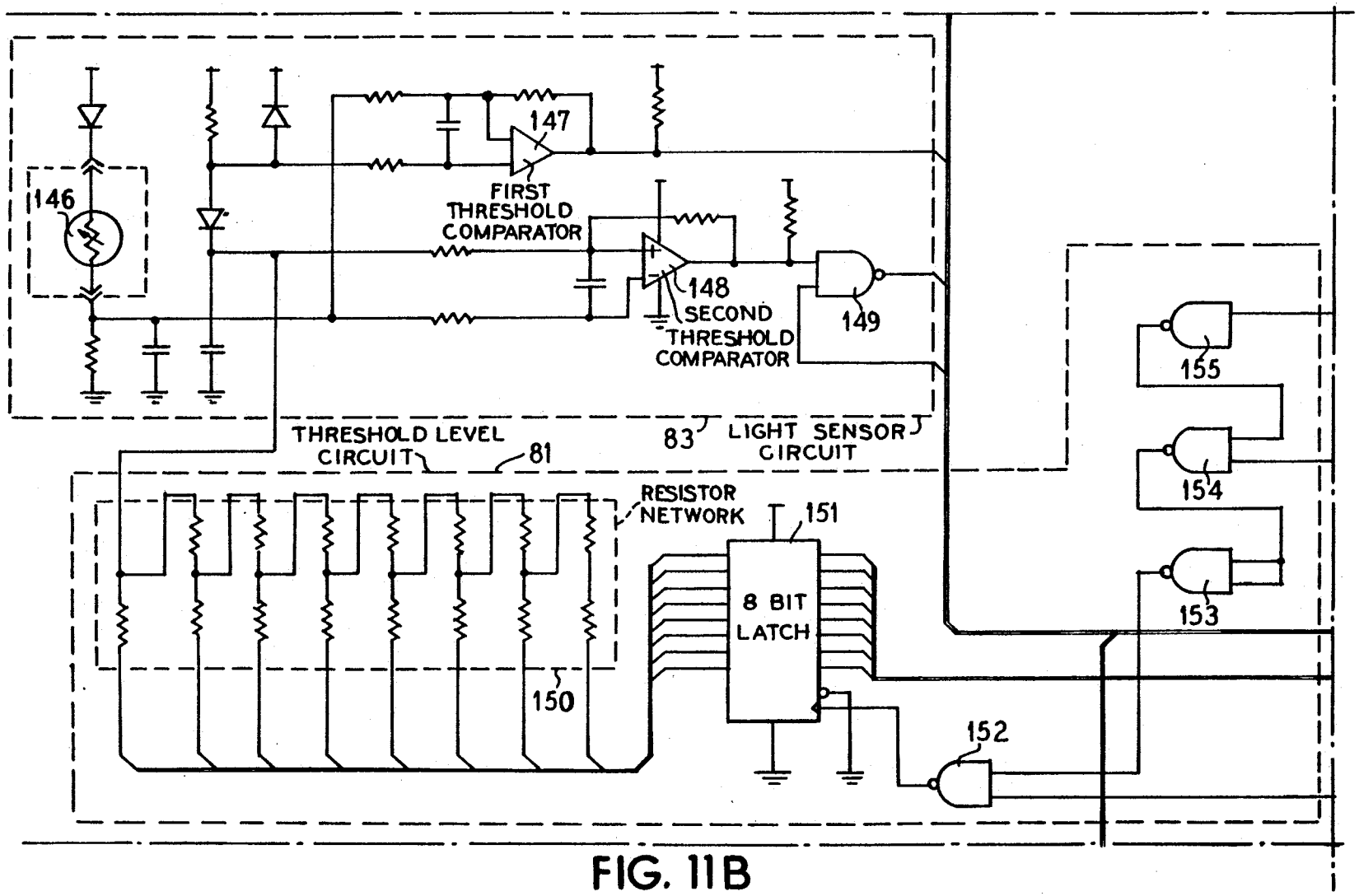
Figure 11C:
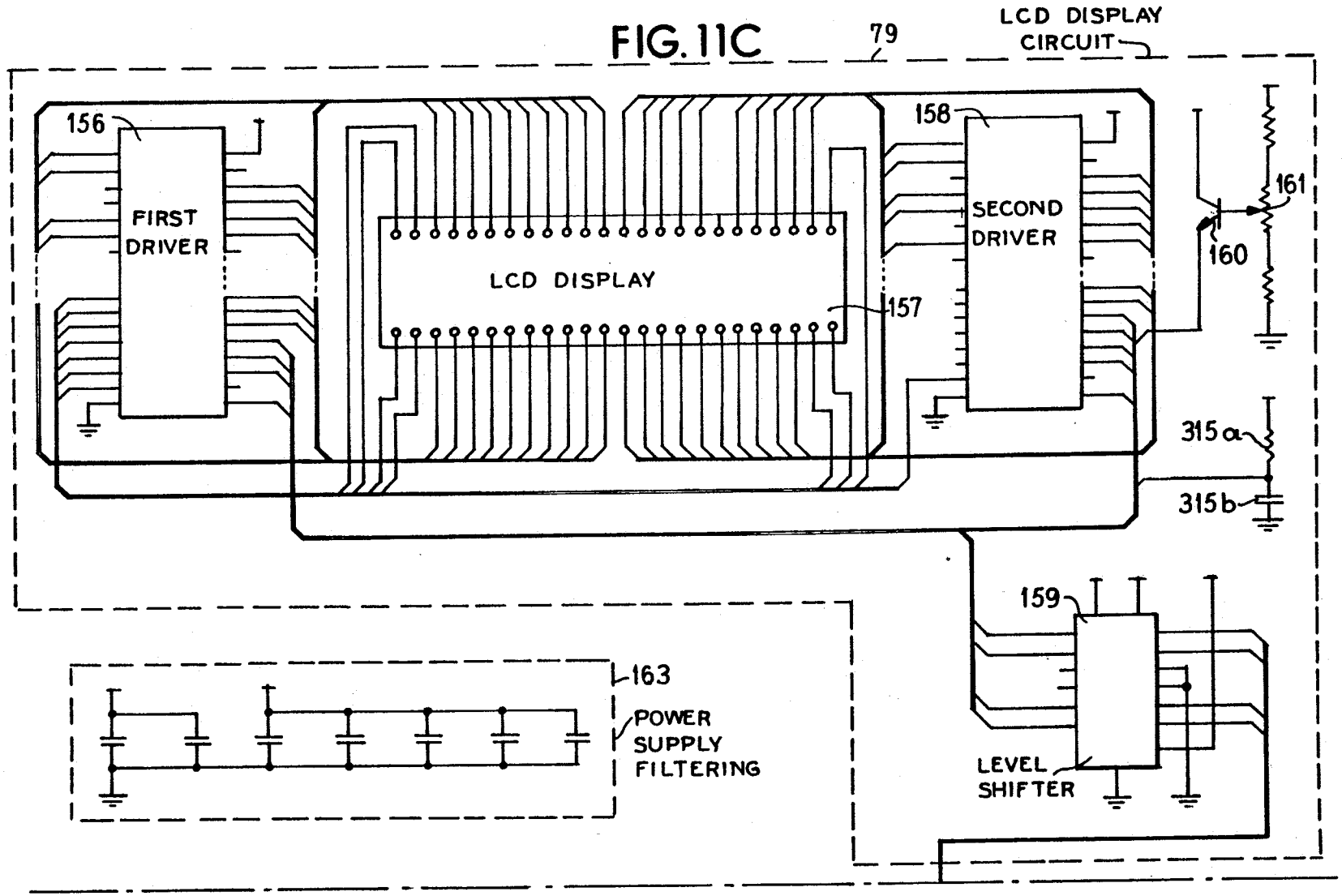
Figure 11D:
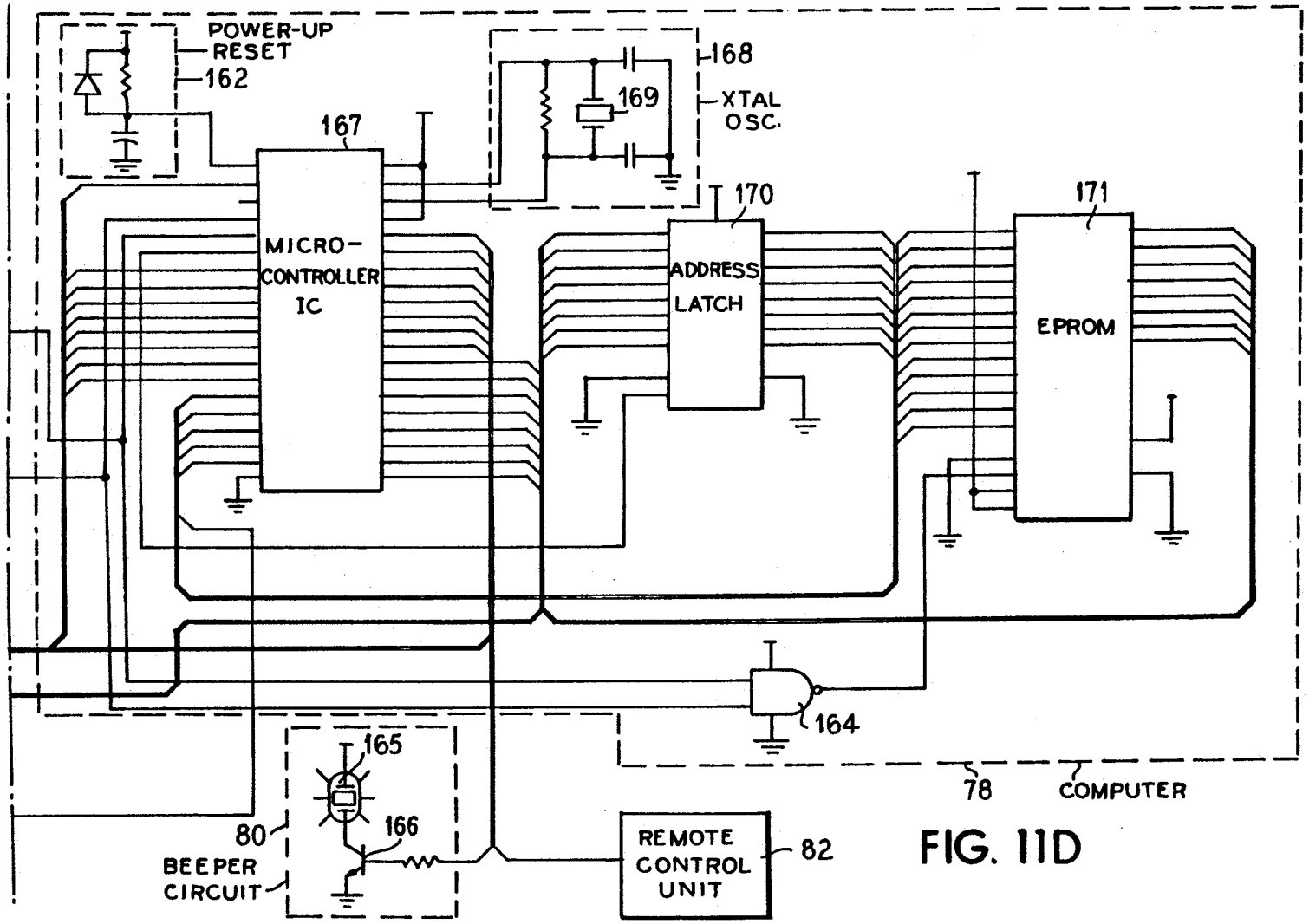

A schematic diagram of the laser unit 17 is shown in FIGS. 10A-B, with the corresponding circuit blocks also indicated in correspondence with FIG. 6A. The battery pack 65 contains a connector 65*a* for the battery pack within the housing of the laser unit. If external power is used, then via the external power circuit 66 and more specifically a jack 9, a voltage is fed to a voltage regulator 112. If the voltage at the external voltage jack is the same as the battery voltage, then a jumper 113 may alternatively be provided, thus jumping out the regulator. A switch 111 which is the power switch, connects with transistor 110 to a control device 114 so as to provide a voltage VCC at the output of transistor 110, depending on the mode of the switch 111. The control device 114 is controlled from a timer 115. This circuitry provides a latching mechanism such that when the switch is pressed the first time, the laser unit goes on, and when the switch is pressed a second time, the laser unit is switched off.

A low battery detector 72 has a voltage sense point at 116 which connects to first and second respective comparators 118 and 119, which also connect to a voltage reference 117. The output from comparator 118 controls the laser flasher 68, and also through transistor 122 controls a timer 123 connected to a flashing LED 124. The output from comparator 119 goes through an auto shut-down transistor 121, which turns off the power supply.

The laser flasher 68 is controlled via transistor 120 whose output connects to a timer 125. An adjustable resistor 126 controls flashing frequency. A second timer 127, having an off-time adjustment 128, is connected to an output of the timer 125. An output of timer 127 controls flashing of the laser 129 of the laser unit 69. Given normal battery voltage, for example, the laser will flash at 100 Hz. Given a low battery condition, the laser will flash at a higher frequency such as 200 or 300 Hz.

The system is programmed so that when a low battery condition develops, a low battery indication is provided on the LCD, but a foul call is not blocked out for a given time delay, such as 3 minutes.

The detecting unit 18 is generally shown in the schematic of FIGS. 11A-D having circuit blocks which correspond to the circuit blocks shown in FIG. 7. More specifically, an external power jack 130 is provided for the power jack circuit 76. This jack connects to a regulator 134, the output of which is also connected to the internal battery pack 75 having batteries 131, via diode 135. A power switch 136 controls power to the unit. With transistors 137*a* and 137*b* and switch mode control chip 138, and along with logic circuit 142 and transformer 139, and logic circuit 141 and adjustment 140, a switch mode power supply is provided having a high voltage output at 145 and a lower voltage output at 144. Power to the computer 78 is provided at line 144 at the output of transformer 139 A low battery signal is provided at the output of logic gate 141 to a bus line to the computer.

The switch input circuit 84 has the start switch 132 and the pause switch 133 connecting to the bus 305, which inputs to the computer 78. The output of logic gate 143 provides a signal to the computer 78 when the power switch 136 is operated.

The light sensor circuit 83 has a light sensor 146 connecting through a first threshold comparator 147 to determine a high threshold output which is provided to the computer. A second threshold comparator 148 is connected to the light detector 146 and has its output connected through a logic gate 149 to provide a fault signal to the computer.

The threshold level circuit 81 has a resistor network 150 for providing a threshold comparison voltage to the comparators 148 and 147. An 8-bit. latch 151 drives the resistor network. The 8-bit latch 151 is controlled by a logic gate 152 which in turn connects to logic gates 153, 154, and 155 controlled by the computer 78.

The LCD display 79 has a first driver circuit 156, a display circuit 157, and a second driver circuit 158. The driver circuits are National type MM58201 and the display circuit is Hamlin type 4284-365-020. Via an adjustable resistor 161 and a transistor 160, the display contrast is controlled. Oscillator components 315*a* and 315*b* connect to both 156 and 158 for internal timing and control.

The computer 78 has a power-up reset circuit 162, a microprocessor 167 (Motorola MC146805E2P), and a connected crystal oscillator 168 having a crystal 169. An address latch 170 (part 74HC373) also is provided as is an EPROM (National NMC27C64Q200) 171, in which the program referred to by the flow chart previously described is stored. A logic gate 164 drives the EPROM. A beeper circuit 80 is also provided having a piezoelectric beeper 165 controlled by transistor 166. A remote control unit 82 connects through the bus line back to the computer 78.

Figure 12:
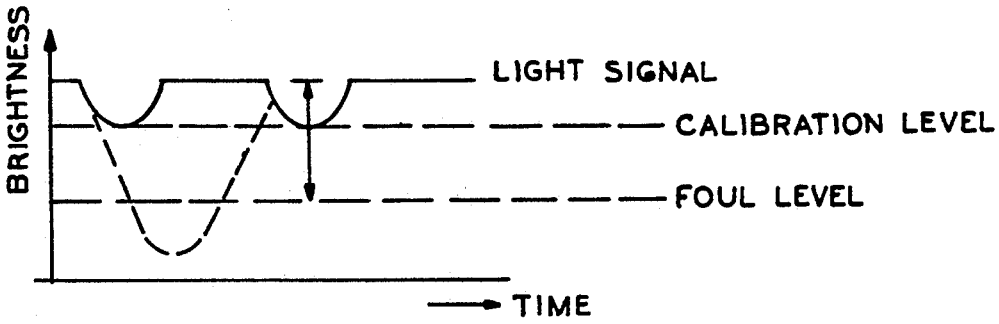
FIG. 12 is a graph explaining light signal foul detection according to one aspect of the invention.

As shown in FIG. 12, a typical light signal is shown together with the result of a typical foul. The calibration level and the foul level of the system are shown. With the invention, the system automatically adjusts to ambient light during the wait and start modes.

Figure 13:
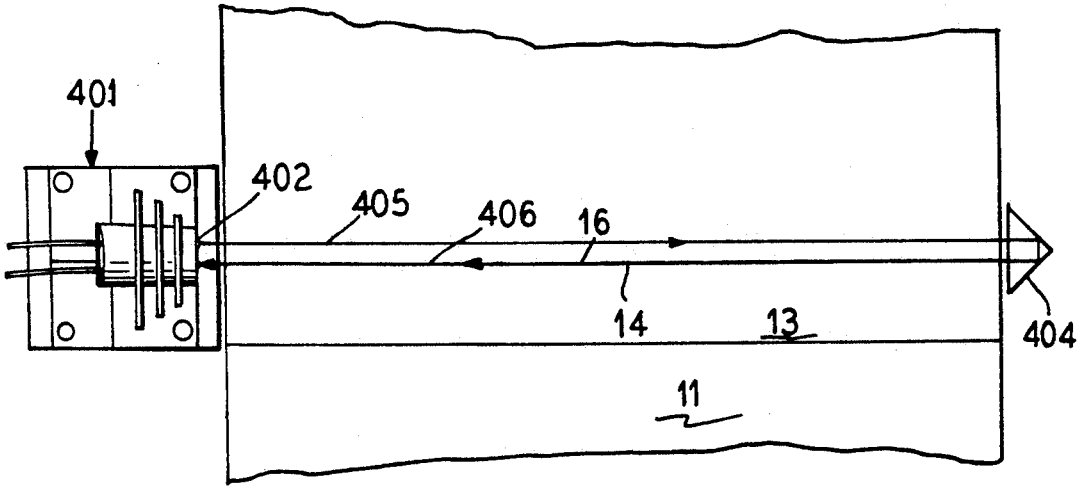
FIG. 13 shows an alternate embodiment wherein a single light emitting and light detecting unit is provided in conjunction with a light reflecting system.

In an alternate embodiment as shown in FIG. 13, instead of providing a separate laser unit and a separate detecting unit, a single laser and detecting unit 401 is provided having a laser output 402 for emitting a laser beam 405 downstream of the foul line, which when reflected, results in a reflected ray 406 which is then detected by the same unit 401 and which is positioned above and parallel to the foul line 14 on the jump board 13 at the end of the approach track The beam 405 is reflected in a reflecting mechanism such as a three-sided prism 404 or a mirror which causes the reflected ray 406 to be parallel to the ray 405, but over the foul line. If the prism rather than a mirror is used, then the incident and reflected rays are closely parallel since the light beam entering the prism is displaced from the light beam leaving the prism.

Alternatively, the incident ray could be positioned over the foul line with the reflected ray downstream; or both rays could lie over the foul line.

Figure 14:
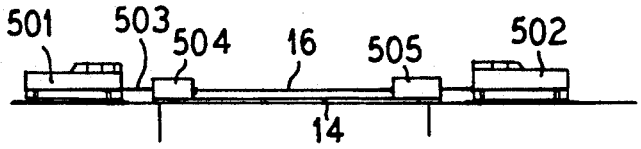
FIG. 14 shows an alternate embodiment wherein a laser emitting member is mounted exteriorly of a laser control unit and wherein a detecting member is located exteriorly of the light detecting unit.

In a further embodiment of the invention shown in FIG. 14, the laser unit 501 has a laser transmitting member 504 mounted exteriorly and remotely therefrom. The laser transmitting member 504 connects to the laser control unit 501 via a cable 503. Similarly, the light detecting unit 502 has a light detecting member 505 mounted exteriorly of the light detecting unit 502. In other respects, the construction of this embodiment is the same as previously described. However, with this embodiment, the laser transmitter 504 and light detector 505 can be made substantially smaller, and thus more easily positioned at the foul line (or at other locations as described in connection with FIG. 15), so as to project a beam 16 which is directly above and aligned with the foul line 14.

Figure 15:
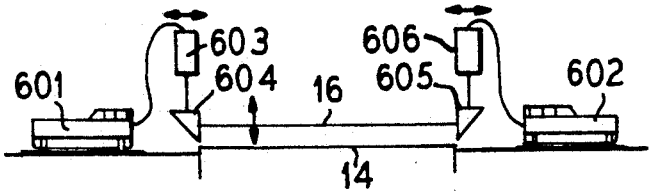
FIG. 15 is an alternate embodiment of the invention wherein a laser emitting member is mounted such that a laser beam is emitted vertically to a prism which bends the laser by 90° and positions it along the foul line.

As shown in FIG. 15, as a further variation of the system of FIG. 14 is provided wherein the laser transmitting member 603, which is separate from the laser control unit 601, radiates a beam vertically to a prism 604 (or alternatively a mirror arranged at 45°) such that a resulting beam 16 is parallel to the foul line 14. Similarly, a prism 605 which again bends the laser beam by 90° may be arranged at the detector 602 side such that the resulting vertically oriented laser beam is detected by a separate detecting unit 606 arranged above the prism 605. With this arrangement, when the transmitting unit 603 is moved horizontally as shown by the arrows, the beams enter at different lateral surface locations of the prism 604. This results in a vertical displacement of the horizontal laser beams 16.

Figure 16:
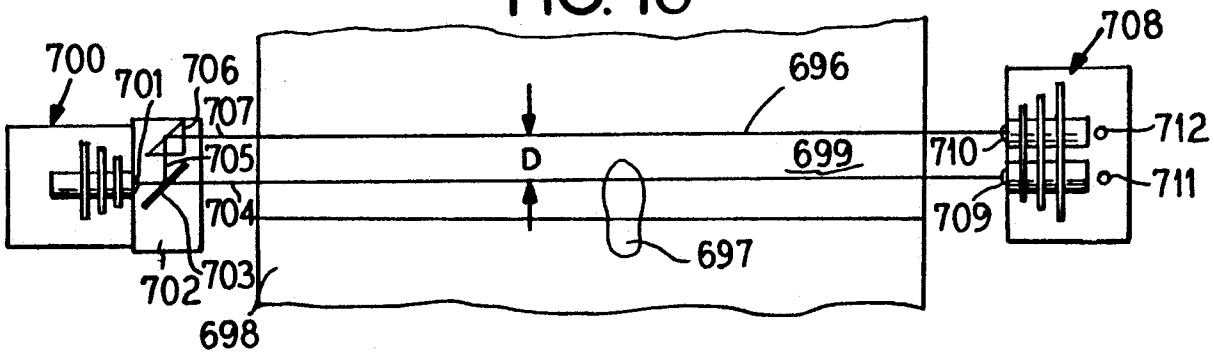
FIG. 16 is an alternate embodiment of the invention wherein both a foul detecting laser beam and a training laser beam spaced from the foul detecting beam is provided.

In a further embodiment of the invention, as shown in FIG. 16, a laser unit 700 is provided like that shown at 17 in FIG. 1, but having a splitter module 702 attached to the front thereof. This splitter module 702 has a beam splitter mirror 703 which reflects a first partial beam 705 and permits a second partial beam 704 to pass through. Preferably, the beams 704 and 705 each have a 50% intensity compared to the other. The first partial beam 705 is bent by 90° through use of a 90° prism 6. The beam 707 emerging from the prism 706 is aligned over the foul or scratch line 696 at the trailing edge of the jumping or take-off board 699 arranged at the end of the take-off track 698. The second partial beam 704 is positioned in front of the foul line 696 and is spaced therefrom by a spacing D. This second beam 704 is arranged at a same height above the jumping board as is the foul detecting beam 707.

By use of the second beam 704 as described above, an indication may be provided to the athlete in training informing the athlete when his jumping foot 697 has approached within a predetermined distance D of the scratch or foul line 696. When this occurs, a detecting unit 708 which is similar to the light beam receiving unit 18 of FIG. 1, but which is capable of detecting both beams 704 and 707, illuminates a light such as 711 indicating to the athlete that he has crossed the laser beam 704 functioning as a training line. If the athlete's foot also crosses the foul line 696 and breaks beam 707, then the foul light 712 will also illuminate and an alarm will be sounded.

Figure 18:
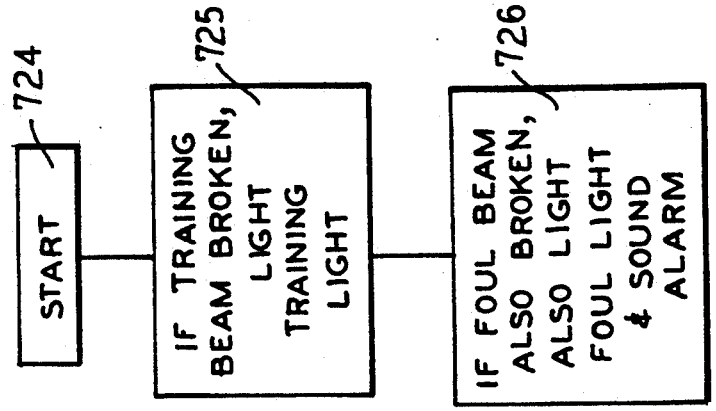
FIG. 18 is a block diagram showing the training beam function of the FIG. 16 system.

The laser light beam detecting unit 708 thus has two light beam receiving entrances 709 and 710 The unit 708 also thus has two light detectors and corresponding circuitry for the two light detectors together with a logic circuitry for illuminating either the 711 lamp or the 711 and 712 lamps simultaneously as described hereafter in connection with FIG. 18. In other respects it is similar to the unit described with respect to FIG. 1.

Figure 17B:
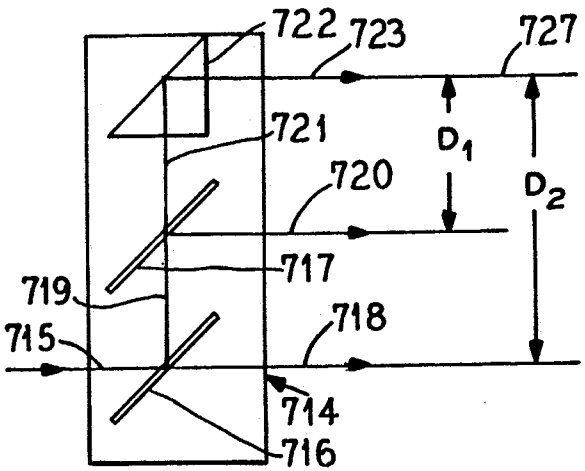
Figure 17A:
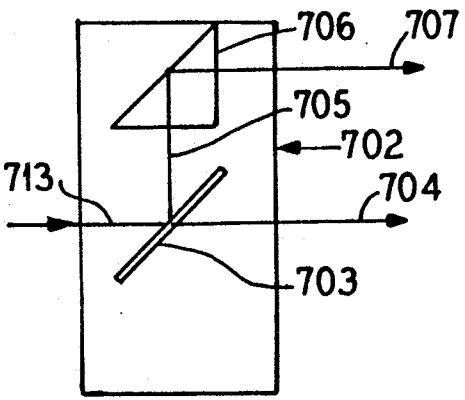
FIG. 17A. is a first embodiment of a beam splitter arrangement used in the system of FIG. 16

FIG. 17A is an expanded view of the beam splitter module 702 which splits the incoming beam 713 into first and second partial beams 704 and 707. Alternatively, as shown in FIG. 17B, a beam splitter 714 may be provided which generates a total of three partial beams with partial beam 723 serving for foul detection, and partial beams 718 and 720 being spaced at respective distances D2 and Dl from the foul line 727, and thus can provide two training lines for the athlete, with the first training line represented by beam 718 being spaced at a greater distance from the foul line.

As shown by the logic diagram of FIG. 18, after the system has initialized itself as previously described and is in a start mode 724, if the training beam such as 704 is broken, then the system turns on the training light (box 725). If the foul beam is also broken by the athlete, then not only the training light but also the foul light is turned on and an audible alarm is sounded (box 726).

It should also be noted that it is within the scope of this invention that fiber optics may be employed so that the actual light transmitting unit and detecting unit do not have to be precisely aligned relative to the foul line, but only ends of the fiber optics at the transmitting side and receiving side.

Although various minor changes and modifications might be proposed by those skilled in the art, it will be understood that we wish to include within the claims of the patent warranted hereon all such changes and modifications as reasonably come within our contribution to the art.

We claim as our invention:

1. A long or triple jump foul detector system for detecting a foul by an athlete when a portion of an athlete's shoe crosses over a long or triple jump foul line when beginning the jump, comprising:

a laser light beam emitting means for projecting a laser light beam;

positioning means for aligning the light beam parallel to the long or triple-jump foul line and directly above the foul line such that a tip of the athlete's shoe will interrupt the beam if the tip of the shoe crosses the foul line as the athlete beging the jump;

light beam detecting means for detecting the interruption of the laser light beam by the tip of the athlete's shoe as the athlete is beginning his take-off for the long or triple jump; and foul detecting means for determining when the light beam has been interrupted by the athlete's shoe and for providing a foul indication of the long or triple jump.

2. A system according to claim 1 wherein the light beam is positioned such that approximately half of the tip of the shoe is below and half of the tip of the shoe is above a horizontal plane passing through the laser beam.

3. A system according to claim 1 wherein the positioning means also positions the light beam for detection by the light beam detecting means.

4. A system according to claim 3 wherein an additional positioning means is provided for positioning the light beam detecting means into proper alignment for receiving the light beam.

5. A system according to claim 1 wherein said light beam emitting is provided in a housing, and said positioning means comprises levelling screw means connected to the housing for vertical positioning of the light beam.

6. A system according to claim 1 wherein said light beam emitting means is provided in a housing, and said housing has projecting locating points which are received in a locating plate, and means for securing the locating plate in a desired lateral position for horizontal alignment of the beam relative to the foul line so that it is directly above the foul line on a mounting surface.

7. A system according to claim 6 wherein the mounting surface comprises ground in an outdoor long or triple jump field event.

8. A system according to claim 1 wherein a hole is dug in the ground, a platform is provided in the hole, and a levelling plate is secured to the platform upon which the light beam emitting means rests, and wherein means is provided for permitting adjustable movement of the mounting plate relative to the platform.

9. A system according to claim 8 wherein the adjustable movement is lateral.

10. A system according to claim 1 wherein the mounting surface comprises a floor at an indoor long or triple jump track event, and wherein tape means is employed for horizontally positioning the locating plate at a desired location on the floor relative to the foul line.

11. A system according to claim 1 wherein the light beam emitting means rests on a locating plate which has a centering line thereon for visual centering along the foul line.

12. A system according to claim 1 wherein said light beam emitting means is powered by a battery pack and wherein means are provided for determining a low battery voltage.

13. A system according to claim 12 wherein said means for determining a low battery voltage includes means for changing a flashing frequency of the light beam for sending a signal to the light beam detecting means indicating that a low battery voltage exists in the light beam emitting means.

14. A system according to claim 1 wherein said light beam emitting means comprises means for causing the light beam to flash at a predetermined flashing frequency.

15. A system according to claim 1 wherein said light beam detecting means comprises a means for detecting laser light.

16. A system according to claim 1 wherein said light beam detecting means has means for detecting low battery voltage in the light beam emitting means based on a signal incorporated in the light beam.

17. A system according to claim 16 wherein said signal comprises a change in a flashing frequency of the light beam.

18. A system according to claim 1 wherein said foul detecting means includes visual indicating means for immediately indicating that a foul has occurred when the light beam has been interrupted.

19. A system according to claim 1 wherein said foul detecting means has means for audibly indicating a foul with a few second delay from a time when the actual foul occurs so as not to disturb the athlete's jump.

20. A system according to claim 1 wherein said foul detecting means determines a foul has occurred only when at least half of the light beam has been interrupted by the athlete's shoe as the athlete begins the jump.

21. A system according to claim 1 wherein said foul detecting means comprises means for distinguishing between a relatively quick interruption of the beam caused by a portion of the athlete's shoe crossing the foul line when beginning the jump as compared to a relatively slower interruption of the beam not caused by the athlete's shoe when beginning the jump.

22. A system according to claim 1 wherein the relatively slower interruption which is distinguished comprises an official putting his hand in the beam such as for a measurement of the jump.

23. A system according to claim 1 wherein the light beam emitting means is positioned at one side in a longitudinal direction along the foul line and the light beam detecting means is positioned opposite the light beam emitting means adjacent the other end of the foul line.

24. A detector system according to claim 1 wherein the light beam emitting means and light beam detecting means are both positioned adjacent one end of the foul line in a longitudinal direction of the foul line and a reflecting means is provided for reflecting the beam emitted from the light beam emitting means back towards the light beam detecting means.

25. A system according to claim 24 wherein the light beam emitting means and light beam detecting means are in a common enclosure at the same end of the foul line.

26. A system according to claim 24 wherein the reflecting means comprises a prism.

27. A system according to claim 24 wherein the reflecting means comprises a mirror.

28. A system according to claim 24 wherein the reflected light beam lies directly vertically above the foul line and the emitted beam lies downstream of the foul line.

29. A system according to claim 24 wherein the emitted beam lies directly above the foul line and the reflected beam lies downstream of the foul line.

30. A system according to claim 24 wherein the emitted beam and the reflected beam both lie directly above the foul line.

31. A system according to claim 1 wherein the light beam emitting means comprises a control unit with an associated remotely located separate light beam transmitting unit in communication with the control unit.

32. A system according to claim 31 wherein the remotely located light beam transmitting unit is positioned for directing the light beam being interrupted by the athlete.

33. A system according to claim 32 wherein the transmitting unit is positioned adjacent and in line with an end of the foul line.

34. A system according to claim 1 wherein the light beam detecting means comprises a control unit and a remotely located separate light beam receiving unit in communication with the control unit.

35. A system according to claim 34 wherein the remotely located receiving unit is located to receive the light beam being interrupted by the athlete.

36. A system according to claim 35 wherein the receiving unit is positioned adjacent and in line with an end of the foul line.

37. A system according to claim 31 wherein the remotely located light beam transmitting unit is positioned so as to radiate a light beam vertically onto means for bending the light beam by substantially 90° such that the bent light beam is parallel to the foul line.

38. A system according to claim 37 wherein the bending means is designed such that a lateral movement of the liqht beam transmitting unit results in vertical movement of the bent beam so that the bent beam moves vertically relative to the foul line.

39. A system according to claim 34 wherein the remotely located light beam receiving unit is positioned for detecting a light beam aligned vertically which has been bent by a light beam bending means by substantially 90° relative to an incoming light beam which is parallel to the foul line.

40. A system according to claim 1 wherein the light beam emitting means projects a first light beam used for foul detection and a second light beam positioned for detecting when an athlete's shoe has approached but not crossed the foul line.

41. A system according to claim 40 wherein the first beam is positioned at a predetermined height above the foul line and wherein the second beam is at said same height but horizontally positioned at a predetermined spacing from the first beam.

42. A system according to claim 40 wherein the light beam emitting means projects a third light beam parallel to the first and second light beams at a position before the athlete's shoe crosses the foul line.

43. A system according to claim 40 wherein a beam splitting mirror is aligned with the light beam and creates one of the two light beams and a bending prism bends a reflected beam from the beam splitter mirror at substantially 90° for creating the other light beam such that the two light beams are parallel to one another but spaced from one another.

44. A system according to claim 43 wherein an additional beam splitter mirror is provided such that three light beams are provided, one from each of the beam splitter mirrors and a third being bent by the prism.

45. A system according to claim 40 wherein means are provided for giving an indication when the second beam is broken, and means are provided for giving an indication when both the foul beam and the second beam have been broken.

46. A long or triple jump foul detector system for detecting a foul by an athlete when a portion of an athlete's shoe crosses over a foul line when beginning the jump, comprising:

light beam emitting means for projecting a light beam;

positioning means for aligning the light beam parallel to the foul line and directly above the foul line such that the athlete's shoe will interrupt the beam if a portion of the shoe crosses the foul line as the athlete begins the jump;

light beam detecting means for detecting the interruption of the light beam by the athlete's shoe;

foul detecting means for determining when the light beam has been interrupted by the athlete's shoe and for providing a foul indication; and an on/off switch and set-up mode means for providing a set-up mode when the on/off switch is switched to "on" and for automatically determining when the light beam projected from the ligh tbeam emitting means is properly aligned for reception by the light beam detecting means.

47. A system according to claim 46 wherein the set-up mode means discontinues the set-up mode when proper set-up has occurred but which reinstitutes the set-up mode if alignment of the beam is lost during operation.

48. A system according to claim 46 wherein the set-up mode means discontinues the set-up mode when a "start" button activation is detected or if a specific period of time elapses with the light beam being properly aligned.

49. A long or triple jump foul detector system for detecting a foul by an athlete when a portion of an athlete's shoe crosses over a foul line when beginning the jump, comprising:

light beam emitting means for projecting a light beam;

positioning means for aligning the light beam parallel to the foul line and directly above the foul line such that the athlete's shoe will interrupt the beam if a portion of the shoe crosses the foul line as the athlete begins the jump;

light beam detecting means for detecting the interruption of the light beam by the athlete's shoe;

foul detecting means for determining when the light beam has been interrupted by the athlete's shoe and for providing a foul indication; and a wait mode means being provided for instituting a wait mode during which ambient light received by the light beam detection means together with the light beam is sampled and a light intensity threshold is set at an appropriate level for given ambient light conditions.

50. A system according to claim 49 wherein start mode means is provided for instituting a start mode whe the wait mode is discontinued, and for sensing for fouls.

51. A system according to claim 50 wherein a timer means is provided in conjunction with the start mode for timing a period during which an athlete shoule complete his jump.

52. A long or triple jump foul detector system for detecting a foul by an athlete when a portion of an athlete's shoe crosses over a foul line when beginning the jump, comprising:

light beam emitting means for projecting a light beam;

positioning means for aligning the light beam parallel to the foul line and directly above the foul line such that the athlete's shoe will interrupt the beam if a portion of the shoe crosses the foul line as the athlete begins the jump;

light beam detecting means for detecting the interruption of the light beam by the athlete's shoe;

foul detecting means for determining when the light beam has been interrupted by the athlete's shoe and for providing a foul indication; and a pause mode means being provided for instituting a pause mode if a relatively long break in the beam is detected which is relatively longer than a short break caused by an athlete jumping.

53. A long or triple jump foul detector system for detecting a foul by an athlete when a portion of an athlete's shoe crosses over a foul line when beginning the jump, comprising:

light beam emitting means for projecting a light beam;

positioning means for aligning the light beam parallel to the foul line and directly above the foul line such that the athlete's shoe will interrupt the beam if a portion of the shoe crosses the foul line as the athlete begins the jump;

light beam detecting means for detecting the interruption of the light beam by the athlete's shoe;

foul detecting means for determining when the light beam has been interrupted by the athlete's shoe and for providing a foul indication; and a foul mode means being provided which provides a foul mode when the light beam hitting the light beam detecting means is disrupted, and for checking whether a long break indicative of an official making a measurement, or a relatively short beam break indicative of a jumper breaking the beam has occurred and for immediately displaying a "foul" indication if the short break has occurred and then after a delay providing an audible foul indication.

54. A system according to claim 53 wherein the foul mode means automatically returns the unit to a wait mode after a predetermined time period has elapsed.

55. A jumping event detector system for detecting a foul across a foul line by an athlete when beginning the jump, comprising:

laser light beam emitting means for projecting a laser light beam;

means positioning the light beam near the jump foul line so that an athlete during a jump will interrupt the light beam if the athlete fouls;

light beam detecting means for detecting an interruption of the laser light beam by a toe portion of the athlete's shoe as he begins the jump;

foul detecting means for determining when the light beam has been interrupted by the athlete and for providing a foul indication; and said fould detecting means employing as a foul triggering reference a vertical plane passing through a center of the beam.

56. A jumping event foul detector system for detecting a foul by an athlete when beginning the jump, comprising:

a jump foul line;

laser beam emitting means for projecting a laser beam;

positioning means for aligning the laser beam directly above the foul line such that a toe portion of a shoe of the athlete will interrupt the beam if the athlete fouls when beginning the jump; light beam detecting means for detecting the interruption of the light beam by the athlete;

foul detecting means for determining when the light beam has been interrupted by the athlete as he begins the jump and for providing a jump foul indication; and a set-up mode means as part of said light beam detecting means for automatically providing visual or audible indications to a user when the laser light beam has been properly aligned.

57. A long or triple jump foul detector system for detecting a foul by an athlete when a portion of an athlete's shoe crosses over a long or triple jump foul line when beginning the jump, comprising:

laser beam emitting means for projecting a laser beam;

positioning means for aligning the laser beam parallel to the foul line and directly above the foul line such that a toe portion of the athlete's shoe will interrupt the laser beam if a portion of the shoe crosses the foul line as the athlete begins the long or triple jump;

laser beam detecting means for detecting the interruption of the laser beam by the athlete's shoe as the athlete is beginning the jump; and foul detecting means for determining when approximately half of a cross-sectional area of the laser beam has been interrupted by the toe portion of the athlete's shoe as he is beginning the jump and for providing a foul indication of the long or triple jump.

58. A long or triple jump foul detector system for detecting a foul by an athlete when a toe portion of an athlete's shoe crosses over a foul line when beginning the jump, and for providing a training indication when an athlete's shoe approaches within a predetermined distance of the foul line prior to the jump, comprising:

a light beam emitting means for projecting a first laser light beam for foul detection and a second laser light beam for athlete training;

positioning means for aligning the first light beam parallel to the foul line and directly above the foul line such that the toe portion of the athlete's shoe will interrupt the first beam if the toe portion of the shoe crosses the foul line as the athlete begins the jump, and for aligning the second light beam parallel to the first beam but spaced therefrom at a position so as to detect when the shoe of the athlete has approached within said predetermined distance of the foul line as the athlete begins the jump;

light beam detecting means for detecting the interruption of the first and second light beams by the athlete's shoe;

foul detecting means for determining when the first light beam has been interrupted by the athlete's shoe and for providing a foul indication; and training detecting means for determining when the second light beam has been interrupted by the athlete's shoe and for providing an indication the athlete has approached within a predetermined distance of the foul line where the second light beam is located.

* * * * *